US007357247B2

(12) United States Patent
Guenther

(10) Patent No.: US 7,357,247 B2
(45) Date of Patent: Apr. 15, 2008

(54) BEVERAGE HOLDER

(75) Inventor: Randy D. Guenther, Wheatridge, CO (US)

(73) Assignee: Coors Global Properties, Inc., Lakewood, CO (US)

( * ) Notice: Subject to any disclaimer, the term of this patent is extended or adjusted under 35 U.S.C. 154(b) by 360 days.

(21) Appl. No.: 10/993,013

(22) Filed: Nov. 18, 2004

(65) Prior Publication Data

US 2006/0102498 A1 May 18, 2006

(51) Int. Cl.
*B65D 75/00* (2006.01)

(52) U.S. Cl. ..... 206/139; 206/170; 206/175; 206/150; 206/161; 206/427

(58) Field of Classification Search ..... 206/139, 206/170, 427, 185, 174, 175, 150, 428, 151, 206/143, 147, 161, 162, 430, 145, 805, 478, 206/479, 526, 193; 53/398; 294/87.2; 220/907; 229/117.09, 117.07
See application file for complete search history.

(56) References Cited

U.S. PATENT DOCUMENTS

| | | | | | |
|---|---|---|---|---|---|
| 981,485 | A | * | 1/1911 | Seldin | 211/13.1 |
| D110,691 | S | | 8/1938 | Dudley | |
| 2,289,859 | A | | 7/1942 | Arthur | |
| 2,581,100 | A | | 1/1952 | Hennessy | |
| 2,710,219 | A | | 6/1955 | Zalkind | |
| 2,808,177 | A | * | 10/1957 | Buttery | 206/175 |
| 2,821,299 | A | | 1/1958 | Crary | |
| D208,012 | S | | 6/1967 | Gale | |
| 3,744,704 | A | | 7/1973 | Struble | |
| D243,913 | S | | 4/1977 | Miles | |
| 4,503,101 | A | * | 3/1985 | Bennett | 428/9 |
| D292,879 | S | | 11/1987 | Smith | |
| 4,889,245 | A | | 12/1989 | Rinke | |
| 4,930,629 | A | * | 6/1990 | Petty | 206/185 |
| 5,154,288 | A | | 10/1992 | Glöyer | |
| D351,971 | S | | 11/1994 | Cappola | |
| 5,450,979 | A | | 9/1995 | Servick et al. | |
| 5,590,762 | A | * | 1/1997 | Harrelson | 206/162 |
| 6,321,906 | B1 | * | 11/2001 | Wein | 206/198 |
| 6,615,996 | B1 | | 9/2003 | Ivey | |
| D502,406 | S | | 3/2005 | Eddings | |
| D520,880 | S | | 5/2006 | Guenther | |
| 2003/0200690 | A1 | * | 10/2003 | Galloway | 40/779 |

* cited by examiner

*Primary Examiner*—Mickey Yu
*Assistant Examiner*—Steven A. Reynolds
(74) *Attorney, Agent, or Firm*—Sheridan Ross P.C.

(57) ABSTRACT

A beverage holder is especially adapted for securing a three-pack arrangement of beverage containers. Three panels are joined along a central axis. The panels are spaced 120° from one another. Lower ends of the panels form stationary bases, and lower portions of the panels may be cut to form foldable base portions that may be deployed or retracted. When deployed, the foldable base portions form additional base support for the holder, and also support the bottom surfaces of the containers. One or more flexible retention members may be secured to the panels and routed around the containers. Because the holder has no top cover and open gaps exist between the panels, the holder is adapted for securing beverage containers of varying heights, diameters, and shapes.

14 Claims, 2 Drawing Sheets

BEVERAGE HOLDER

FIELD OF THE INVENTION

The present invention relates generally to packaging for holding a plurality of beverages, and more particularly, to a beverage holder especially adapted for securing a three-pack arrangement of beverages.

BACKGROUND OF THE INVENTION

Beverages are often sold in groups, such as a pack of 6, 12 or 24 beverages. For soda and beer, these group or pack arrangements are perhaps the most popular packaging methods for retail sales. The type of packaging material used to secure the beverages may include material such as compressed paperboard, plastic, etc. Both bottles and cans are popularly distributed at retail locations in these pack arrangements.

There are few desirable or advantageous considerations in designing beverage packaging. One design consideration is to minimize the amount of material that has to be used to properly secure the beverages. Another consideration is to provide packaging with enough exposed planar surfaces so that the packaging may effectively display printing or other types of labeling for identifying the product to be sold. Yet another consideration is to provide functional packaging, but maintain some aesthetic value in the packaging.

There are a number of prior art examples of beverage containers to include the U.S. Pat. Nos. Des. 243,913; Des. 351,971; 2,289,859; 2,821,299; 4,889,245; 5,154,288; 5,450,979; and 6,615,996.

Although the 6-pack has long been a popular packaging arrangement for beverages, more recently, many beverages are provided in containers that have more than the traditional 12-ounce capacity. Many consumers choose to consume more than one beverage at one time; therefore, product distributors have recognized that providing larger beverage containers ultimately reduces the number of containers that have to be provided. However, because of these larger sized containers, traditional packaging methods have to be modified, and are not necessarily the optimum methods in which to package such larger containers.

In the beer industry, the 24-ounce container has become popular. Therefore, there is a need to provide a beverage holder which will accommodate a plurality of 24-ounce containers, yet maintain some of the desired design considerations set forth above.

SUMMARY OF THE INVENTION

In accordance with the present invention, a beverage holder is provided that is especially adapted for holding three beverage containers, such as three 24-ounce beverage containers. When loaded with containers, the beverage holder may also be referred to as a beverage pack. In the preferred embodiment, the beverage holder comprises three panels or legs that intersect along a central axis. The central axis is defined by a plurality of folds in the panels which intersect at a central location. In the preferred embodiment, three panels are spaced from one another approximately 120°. Each of the panels has a stationary base portion fonning a lower end of the panels. A plurality of foldable base portions are also provided at the lower ends of the panels. The foldable base portions are formed by cuts made in the panels. The foldable base portions are then folded away from the panels forming additional base support and thereby increasing the overall stability of the beverage holder. The panels may be cut in a desired shape to accommodate any special packaging needs such as the particular size of the containers, as well as desired advertising or promotions to be placed on or represented by the panels. The panels extend radially away from the central axis thereby forming pie-shaped gaps which are sized to receive the containers. Preferably, one container is placed over the upper end of each foldable base portion. The upper end of each foldable base portion may include a protrusion, and the protrusion resides in the concave lower surface of the container. Accordingly, the foldable base portions also function to secure the containers. Each container extends upward through the corresponding pie-shaped gap between the adjacent panels. One or more flexible retention members such as a cord, strap, or string may be attached to and between each of the panels. The flexible member may then be routed around the outer surfaces of the containers thereby further securing the containers to the holder. The upper ends of the panels may include finger holes that allow the consumer to conveniently carry the beverage holder. When a consumer desires to consume one of the beverages, the user simply lifts up on the container and beyond the flexible member thereby removing the beverage from attachment with the holder.

Because there are no glued flaps or perforations that must be broken, the beverage holder of the present invention can be reused. The beverage holder provides adequate support and stability for the beverages, yet also economizes use of packaging materials. The arrangement of the panels is such that each of the panel surfaces remain exposed thereby enhancing the ability of the panels to have product labels/advertising placed thereon. When the beverage holder is not in use, the holder may be conveniently folded in a very compact configuration.

Various other features and advantages of the present invention will become apparent from a review of the following detailed description taken with the drawings.

DETAILED DESCRIPTION

Figure 1:
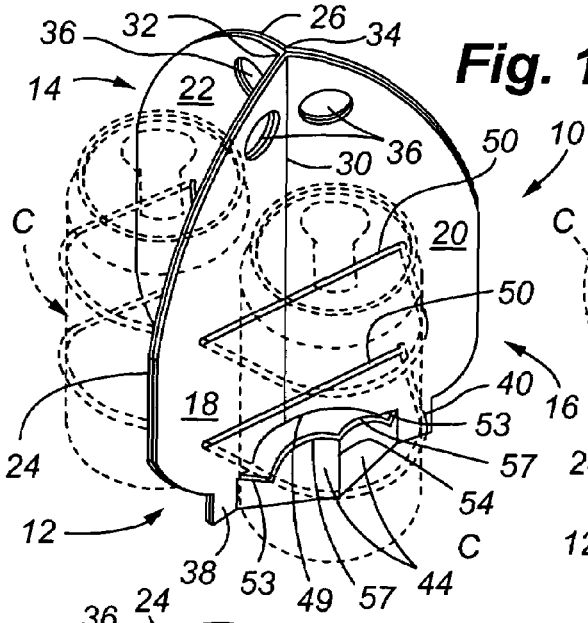
FIG. 1 is a perspective view of a first embodiment of the beverage holder of the present invention.

Referring to FIG. 1, the beverage holder 10 of the present invention is illustrated, along with a plurality of beverages C in dotted lines. The major elements of the holder include three panels or legs, namely, first panel 12, second panel 14, and third panel 16. When the holder is deployed for use, the panels are spaced from one another approximately 120° as shown. Each of the panels have two exposed and opposing sides. For panel 12, it includes sides 18 and 24. For panel 14, it includes sides 22 and 26, and for panel 16, it includes sides 20 and 28. The panels intersect one another along a central axis defined by fold lines 30, 32, and 34 as shown. One preferred way in which to construct the holder is to provide three separate sheets of material, bisecting each of the sheets of material forming the fold lines 30, 32, and 34, and then adhering the sheets of material together to form the three panels. Thus, one sheet of material forms adjacent sides of adjacent panels. One acceptable material for use includes die-cut pieces of chip-board carrier. Many other materials may be used to include compressed paperboard, cardboard, etc. In the first embodiment, the panels have been cut to a shape which resembles a football. Any type of printing, embossing or labeling may be incorporated on the panels to appropriately display product identification and advertising. Furthermore, the panel surfaces may be laminated or may receive some other surface treatment to provide a desired surface finishing. A plurality of finger holes 36 may be formed on the upper ends of the panels thereby providing a convenient means for carrying the beverage holder and containers.

Figure 2:
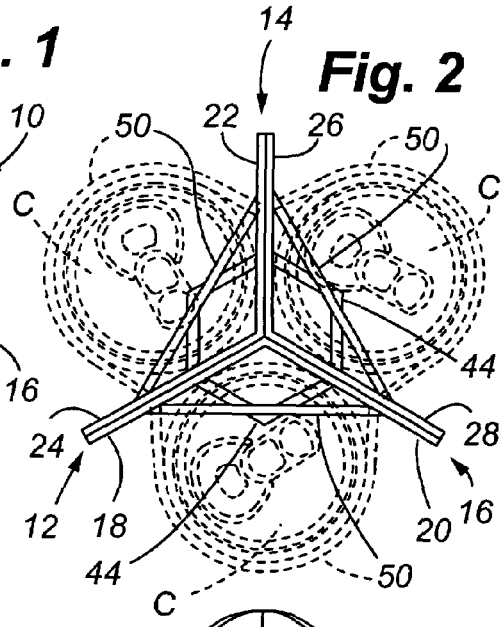
FIG. 2 is an upper plan view of the beverage holder.
Figure 3:
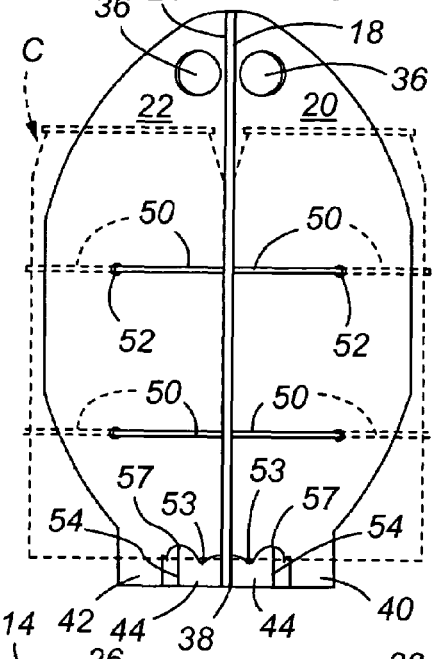
FIG. 3 is a side elevation of the beverage holder.
Figure 4:
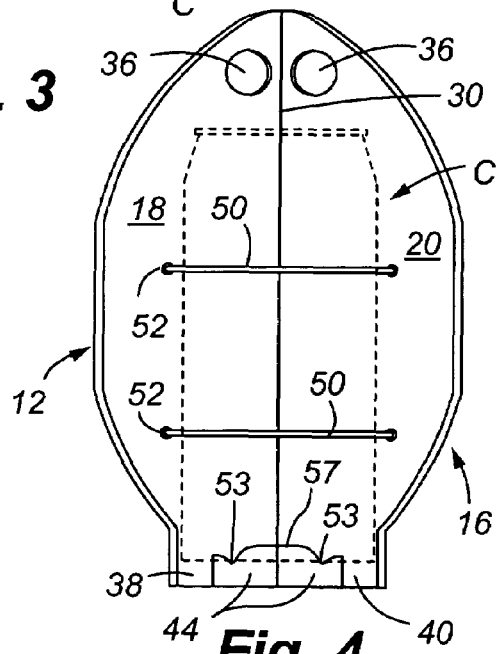
FIG. 4 is another side elevation of the beverage holder.
Figure 5:
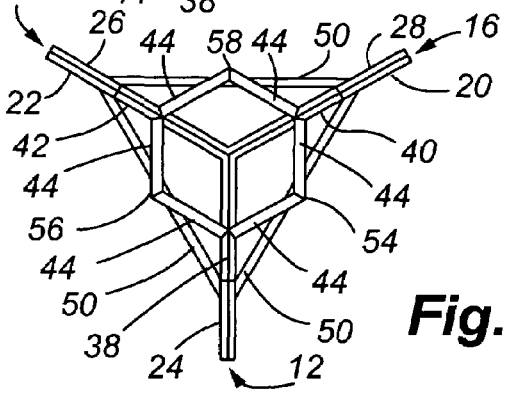
FIG. 5 is a lower plan view of the beverage holder.

The lower ends of the panels may be defined as including stationary base portions 38. Preferably, the lower edge of these base portions are co-planar that allows the beverage holder to stand upright as shown. Additional stabilization may be provided for the beverage holder by incorporating a plurality of foldable base portions 44. The foldable base portions are formed by creating a cut in the panels along lines 49, and then folding the material residing below the cut away from the panels along a base fold 54. As best seen in FIGS. 2 and 5, the foldable base portions 44 provide additional stabilization for maintaining the beverage holder in the upright position. Additionally, the particular shape of the foldable base portions may be such that they include protrusions 57 which are received in the concave lower surfaces of the beverage containers C. Depending upon the size and shape of the container, the size of the cuts 49 as well as the shapes and sizes of the protrusions 57 may be altered to accommodate the particular container. For example, for containers that have a greater diameter, the lengths of the cuts 49 may be increased so that when the foldable base portions are deployed, they extend out farther away from the panels. For containers such as some bottles that do not have a concave lower surface that is as pronounced as beverage cans, the protrusions 57 can be made smaller to best follow the particular contour of the lower surface of the bottle. The rims or edges of the containers rest on the recessed portions 53 of the foldable base portions. Thus, the foldable base portions serve a dual purpose in not only stabilizing the holder for upright positioning, but also for securing the beverage containers.

In order to fully secure the beverage containers to the beverage holder, one or more flexible retention members 50 may be used. The retention members 50 may be elastic straps, bands, or cords, or may simply be selected lengths of string or other flexible material which are routed around the containers as shown in dotted lines. In the preferred embodiment, there are two retention members which traverse between adjacent panels. One preferred manner in which to provide the retention members 50 would be to incorporate two vertically spaced and continuous elastic cords that are routed through openings 52 formed in the panels.

Figure 6:
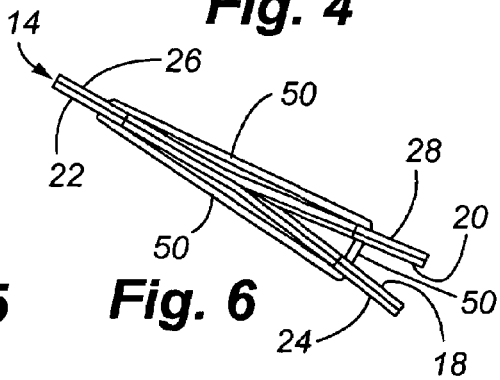
FIG. 6 is an upper plan view of the beverage holder when folded for storage.
Figure 7:
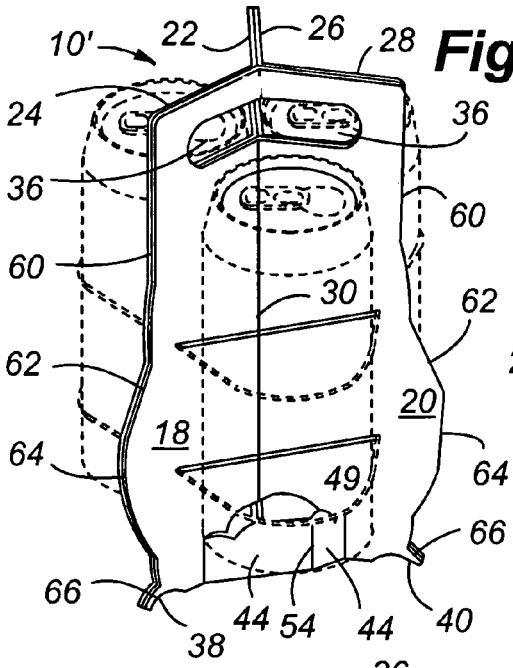
FIG. 7 is a perspective view of another embodiment of the beverage holder of the present invention.
Figure 8:
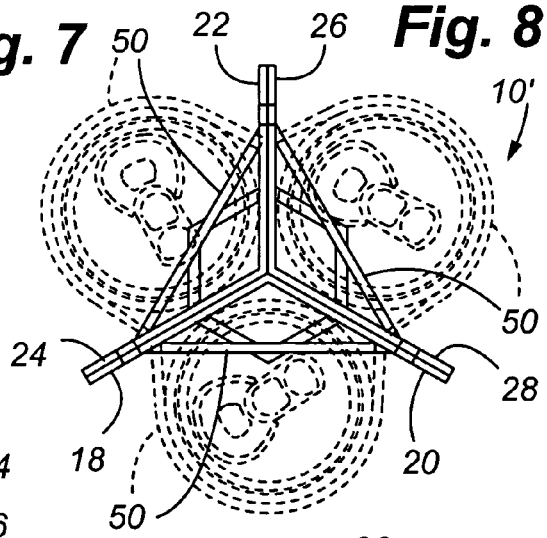
FIG. 8 is an upper plan view of the second embodiment.
Figure 9:
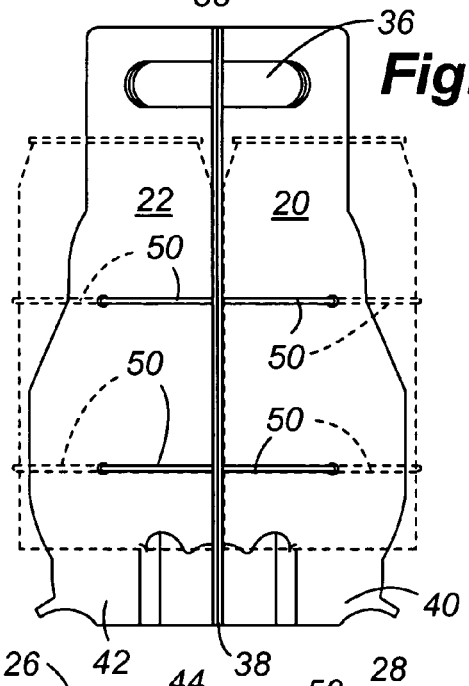
FIG. 9 is a side elevation of the second embodiment.
Figure 10:
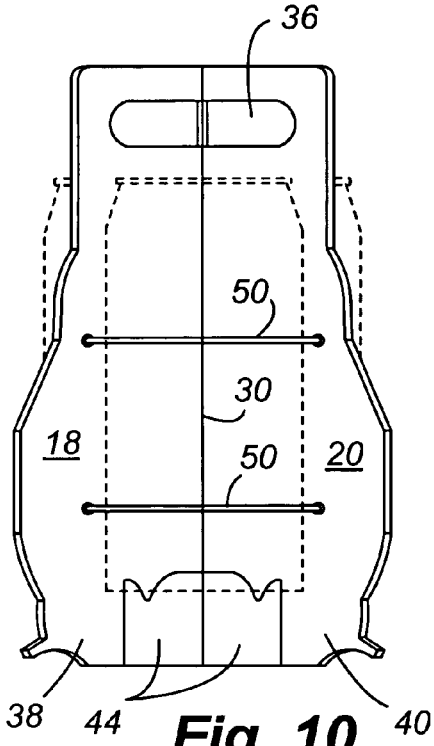
FIG. 10 is another side elevation of the second embodiment.
Figure 11:
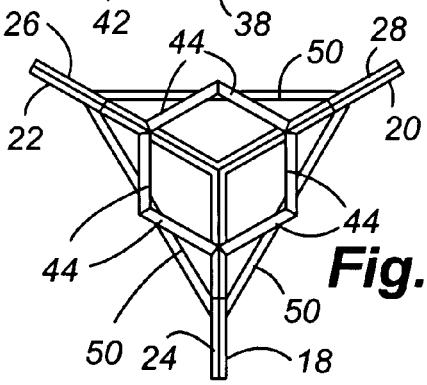
FIG. 11 is a lower plan view of the second embodiment.
Figure 12:
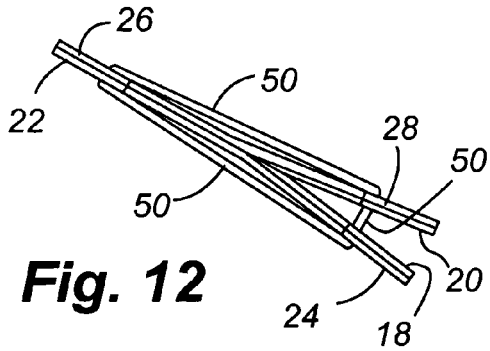
FIG. 12 is an upper plan view of the second embodiment when folded for storage.

FIG. 6 illustrates the beverage holder when the beverage holder is not in use. The holder may be collapsed by simply pushing one of the foldable base portions 44 back to its retracted position, and then folding the two adjacent panels against one another. The holes 52 can be sized to allow the holes to easily slide along the retention straps when the two panels are folded towards one another. When it is desired to use the beverage holder again, the two joined panels are separated from one another so that the panels return to their 120° spacing, and the retracted foldable base portion is returned to its deployed position by pulling the foldable base portion out away from the adjacent panels.

FIGS. 7-12 illustrate a second embodiment of the present invention. The appreciable distinctions between the first and second embodiments are the particular shape of the panels and the shape of the finger holes. Like reference numbers are used in the second embodiment denoting the same corresponding elements from the first embodiment. The second embodiment incorporates panel shapes resembling the profile of a race car. More specifically referring to FIG. 7, a hood of the race car can be envisioned along panel edge portion 60, a windshield at edge portion 62, a rooftop at edge portion 64, and a tail fin at edge portion 66. Those skilled in the art can envision any number of other different shapes that may be adopted for the panels to simulate objects to be used for advertising or promotion.

With the present invention, a structurally simple beverage holder is provided that provides adequate securement for a plurality of beverages, but also provides presentation of the beverages in an aesthetically pleasing beverage holder. The beverage holder is reusable, and may be conveniently stored by folding the holder as described above. Because the holder has no top cover constituting a height constraint and has open gaps between panels, the beverage holder is adapted to receive many different sizes and shapes of containers. An elastic retention member enhances the ability of the beverage holder to secure containers of different sizes and shapes.

While the foregoing invention has been described with reference to preferred embodiments, it shall be understood that various other changes may be made to the present invention that fall within the scope of the claims appended hereto.

I claim:

1. A beverage holder comprising:

at least three panels joined to one another at first ends along a central axis, said panels each having respective second ends extending radially away from the central axis creating open gaps between each panel, each of said second ends not contacting another portion of said beverage holder;

a plurality of foldable base portions formed from lower ends of said panels, said foldable base portions being selectively placed between a retracted position wherein the base portions extend co-linearly with the corresponding panels and a deployed position wherein the base portions extend away from the central axis and the panels; and a flexible member spanning between each panel and being spaced above said lower end of said panels.

2. A beverage holder, as claimed in claim 1, further including:

a plurality of finger holes formed in said panels at an upper end of said panels.

3. A beverage holder, as claimed in claim 1, wherein:

said central axis is defined by an intersection of fold lines separating said plurality of panels.

4. A beverage holder, as claimed in claim 1, wherein:

said flexible member includes a plurality of flexible members spanning between said panels.

5. A beverage holder, as claimed in claim 1, wherein:

said plurality of foldable base portions are formed by a cut made along lower portions of said panels.

6. A beverage holder, as claimed in claim 1, wherein:

said panels each include corresponding stationary base portions having lower surfaces substantially co-planar with one another.

7. A beverage holder comprising:

a plurality of panels joined to one another along a central axis, said panels being spaced from one another creating gaps between each panel, each panel having a corresponding stationary-based portion formed at a lower end of each panel;

a plurality of foldable base portions formed at said lower ends of said panels, said foldable base portions being selectively placed between a retracted position and a deployed position; and said foldable base portions each further include a protrusion especially adapted for being received in a concave lower surface of a beverage container.

8. A beverage holder, as claimed in claim 7, wherein:

said foldable base portions are each bisected by a base fold.

9. A beverage pack comprising:

a plurality of panels joined to one another along a central axis, said panels being spaced from one another creating gaps between each panel, each panel having a corresponding stationary-based portion formed at a lower end of each panel;

a plurality of foldable base portions formed at said lower ends of said panels, said foldable base portions being selectively placed between a retracted position and a deployed position;

a plurality of beverages, one beverage being placed over each foldable base portion and each beverage being secured to said beverage holder; and said foldable base portions each further includes a protrusion specially adapted for being received in a concave lower surface of a beverage container.

10. A beverage holder, as claimed in claim 9, wherein:

said foldable base portions are each bisected by a base fold.

11. A beverage holder comprising:

a plurality of panels spaced from one another and intersecting along a central axis, said panels extending radially away from the central axis creating open gaps between each panel; and means formed at lower ends of said panels for selectively supporting said panels to maintain said panels in an upright position, said means for supporting being selectively placed between a retracted position and a deployed position, said means for supporting further includes a protrusion especially adapted for being received in a concave lower surface of a beverage container.

12. A beverage holder, as claimed in claim 11, further including:

at least one flexible member spanning between each panel and spaced above said lower ends of said panels.

13. A beverage holder, as claimed in claim 11, further including:

a plurality of finger holes formed in said panels at an upper end of said panels.

14. A beverage holder, as claimed in claim 11, wherein:

said central axis is defined by an intersection of fold lines separating said plurality of panels.

* * * * *